United States Patent [19]

Hill et al.

[11] Patent Number: 4,925,602

[45] Date of Patent: May 15, 1990

[54] METHOD FOR IMPROVING THE CRIMPING OF POLYOLEFIN FILTER TOW

[75] Inventors: Michael Hill, Ascot, England; Walter A. Nichols, Richmond, Va.

[73] Assignee: Filter Materials Limited, New York, N.Y.

[21] Appl. No.: 231,148

[22] Filed: Aug. 10, 1988

[51] Int. Cl.[5] ..... D01D 5/22; D01D 5/42

[52] U.S. Cl. ..... 264/25; 264/26; 264/147; 264/168; 264/563; 264/DIG. 47

[58] Field of Search ..... 264/DIG. 47, 563, 25, 264/26, 147, 168; 28/257

[56] References Cited

U.S. PATENT DOCUMENTS

| | | | |
|---|---|---|---|
| 2,914,810 | 12/1959 | Robinson et al. | 19/66 |
| 3,336,174 | 8/1967 | Dyer et al. | 264/DIG. 47 |
| 3,398,441 | 8/1986 | Adachi et al. | 264/DIG. 47 |
| 3,494,522 | 2/1970 | Kim et al. | 225/97 |
| 3,495,752 | 2/1970 | Kim et al. | 225/3 |
| 3,496,260 | 2/1970 | Guenther et al. | 264/156 |
| 3,500,517 | 3/1970 | Dekker et al. | 28/1.5 |
| 3,500,518 | 3/1970 | Stanley et al. | 28/1.6 |
| 3,500,627 | 3/1970 | Kim | 57/140 |
| 3,526,349 | 9/1970 | Moro | 225/97 |
| 3,565,308 | 2/1971 | Slack | 225/97 |
| 3,566,735 | 3/1971 | Greene | 83/344 |
| 3,577,724 | 5/1971 | Greene | 57/157 |
| 3,579,618 | 5/1971 | Stewart et al. | 264/DIG. 47 |
| 3,582,418 | 6/1971 | Schuur | 264/DIG. 47 |
| 3,595,454 | 7/1971 | Kalwaites | 225/3 |
| 3,726,079 | 4/1973 | Feild et al. | 57/155 |
| 3,739,053 | 6/1973 | Yazawa | 264/154 |
| 3,756,484 | 9/1973 | Guenther | 225/97 |
| 3,787,261 | 1/1974 | Heger et al. | 156/84 |
| 3,801,252 | 4/1974 | Waterhouse | 425/304 |
| 3,835,513 | 9/1974 | Stanley | 28/72.14 |
| 3,880,173 | 4/1975 | Hill | 131/269 |
| 3,883,936 | 5/1975 | Stanley | 28/72.14 |
| 3,927,957 | 12/1975 | Chill et al. | 425/131.1 |
| 3,949,454 | 4/1976 | Irwin | 28/72.14 |
| 3,985,600 | 10/1976 | Blais | 156/229 |
| 3,985,933 | 10/1976 | Mehta et al. | 428/357 |
| 4,129,632 | 12/1978 | Olson et al. | 264/40.1 |
| 4,133,087 | 1/1979 | Li | 28/257 |
| 4,133,088 | 1/1979 | Hikobe | 264/DIG. 47 |
| 4,134,951 | 1/1979 | Dow et al. | 264/147 |
| 4,273,600 | 6/1981 | Luke | 156/180 |

FOREIGN PATENT DOCUMENTS

| | | |
|---|---|---|
| 971878 | 10/1964 | United Kingdom . |
| 1207733 | 10/1970 | United Kingdom . |
| 1260957 | 1/1972 | United Kingdom . |
| 1339496 | 12/1973 | United Kingdom . |

*Primary Examiner*—James Lowe

*Attorney, Agent, or Firm*—Jeffrey H. Ingerman

[57] ABSTRACT

A method is provided for heating fibrillated polyolefin film prior to crimping, to improve the crimping, and thus the yield and variability as a filter, of the tow. The fibrillated tow is crimped while still hot from the heating step. The resulting fibers have more uniform crimping at higher levels than those not subject to heating.

19 Claims, 2 Drawing Sheets

METHOD FOR IMPROVING THE CRIMPING OF POLYOLEFIN FILTER TOW

BACKGROUND OF THE INVENTION

This invention relates to the manufacture of polyolefin tow for use in cigarette filters. In particular, this invention relates to a method and apparatus for improving the crimping of polyolefin filter tow.

It is known to produce polyolefin filter tow by slitting polyolefin film to fibrillate the film, and then subjecting the fibrillated film to a crimping operation. Crimping the fibrillated film gives it more bulk, and makes it "fluff up" so that it is more like traditional cigarette filter materials, such as cellulose acetate. One such polyolefin filter tow and its manufacture are described in U.S. Pat. No. 3,880,173.

The crimp imparted to the fibrillated film is characterized by a crimp frequency and a crimp amplitude. If a crimped fiber is compared to a sine wave, it has a certain number of crimps per inch (cpi) and each crimp has a certain amplitude. The crimp amplitude generally decreases as the crimp frequency increases.

When fibrillated polyolefin film is made into filter tow, and cigarette filters are made from the tow, the tow has a certain "yield", defined as the pressure drop obtainable from a given weight of filter tow. Yield may by measured, for example, in millimeters of water per milligram (mm WG/mg). It is desirable to maximize the yield from a given weight of filter tow. One known way of increasing the yield is to increase crimp frequency and uniformity.

It is also desirable to decrease the variability of the filter tow, in terms of density, so that every filter produced presents nearly the same feel to a smoker. Variability can also be decreased by increasing crimp frequency and uniformity.

It has heretofore been difficult to achieve significant improvements in crimp frequency. Crimp can be imparted to the fibrillated film fibers by gear tooth crimping, false twist crimping, or stuffer box crimping. The former two crimping methods suffer from known inherent mechanical limitations on the achievable crimp frequency. In stuffer box crimping, in which the fibrillated film is essentially rammed into an immovable wall, causing it to collapse, imparting crimp, there is no mechanical limitation, but the resilience of the fibers, and the stresses induced by the fibrillation process, make it difficult to increase the crimp frequency, and to achieve uniform crimping along a fiber.

It would be desirable to be able to increase crimp frequency and uniformity in fibrillated polyolefin filter tow and thereby to improve the yield and variability of the filter tow.

SUMMARY OF THE INVENTION

It is an object of this invention to increase crimp frequency and uniformity in fibrillated polyolefin filter tow and thereby to improve the yield and decrease the variability of the filter tow.

In accordance with this invention, there is provided a method of making polyolefin filter tow. The method comprises, in the following order, the steps of:

1. Forming a polyolefin film having a molecular structure.

2. Orienting the molecular structure by heating the film to just below its melting point and stretching the heated film.

3. Fibrillating the oriented film to form an interconnected fiber web.

4. Heating the fibrillated web to a temperature above ambient temperature.

5. Crimping the heated fibrillated web.

Apparatus for carrying out the method is also provided.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

Figure 1:
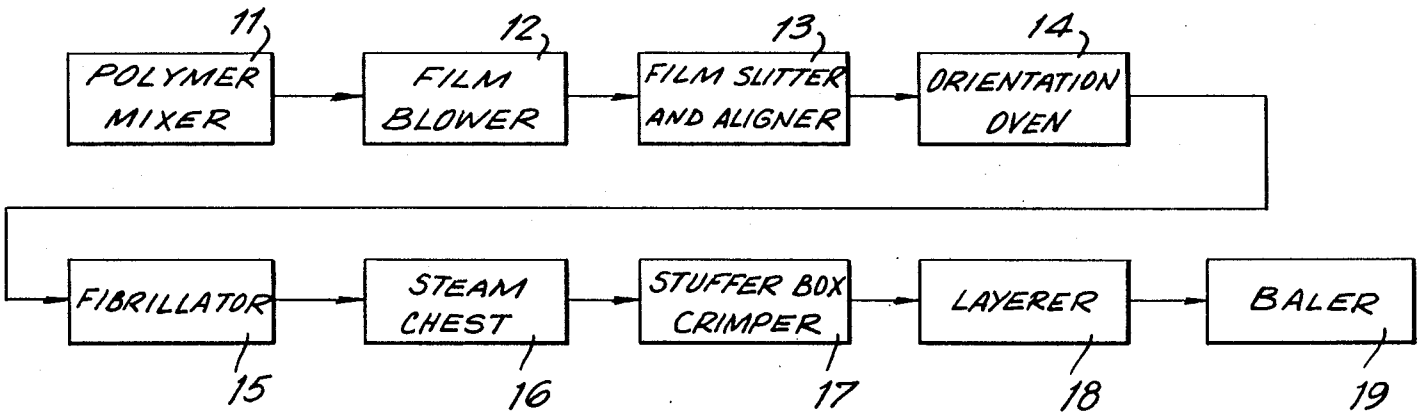
FIG. 1 is a block diagram of apparatus for producing polyolefin filter tow.

Apparatus 10 for forming polyolefin filter tow is shown in block diagram form in FIG. 1. Selected polymers are blended in polymer mixer 11. As described more fully in copending, commonly assigned U.S. patent application Ser. No. 07/231,147, filed concurrently herewith, which is hereby incorporated by reference in its entirety, polyolefin filter tow in the preferred embodiment is made primarily of polypropylene with small amounts of polyethylene and whiteners.

A polyolefin film is blown, or extruded, in film blower 12, which is a conventional film blower such as Extrusion Systems Ltd., Model 0100. Blower 12 forms a cylindrical "bubble" of polyolefin film, having a thickness between about 20 microns and about 50 microns, and preferably about 35 microns. The film "bubble" is collapsed down to a flat two layer configuration, and it then, in the preferred embodiment, enters film slitter and aligner 13 where it is slit into, preferably, three two-layer bands which are aligned on top of one another to form one six-layer band. The six-layer band is itself preferably slit into two bands for parallel processing, allowing the simultaneous production of two tow batches with possibly different properties, if desired. In the discussion which follows, only the course of one of the two parallel bands will be discussed, the other band undergoing substantially the same treatment.

The six-layer band is then passed through orientation oven 14, where it is preferably heated to about 160° C., just below the melting point of the film, while being stretched between two sets of rollers. The drawing set of rollers rotates at between about 5 and about 13 times the speed of the feeding rollers, and preferably between about 7 and about 10 times the speed of the feeding rollers. This "orientation" process aligns the molecular structure of the film, creating the physical characteristics necessary for fibrillation. The film thickness is also decreased to between about 8 microns and about 17 microns, and preferably about 12.4 microns, by the stretching caused by the roller speed differential.

The oriented film band then enters fibrillator 13 which turns film into fiber by contacting the film with a relatively large number of relatively fine pins set in one or more fibrillating rollers which rotate as the film passes over them. The film contacts only about 20–45 degrees of arc of each of the rollers, preferably about 37 degrees, and the speed of the film is about twice that of the surface of the fibrillating rollers. The ratio of film speed to fibrillation roller speed is known as the "fibrillation ratio." As a result of fibrillation, if the band is expanded laterally, an interconnected network of fibers would be apparent, with a certain proportion of free ends. In fact, the free ends may play an important role in filtration in filters made from the fibrillated film, and the higher the proportion of free ends, the better the filter.

According to the present invention, the fibrillated film is then passed through steam chest 16, as discussed more fully below. After passing through steam chest 16, or immediately after fibrillation in previously known tow-making apparatus, the fibrillated tow is crimped. As stated above, there are several known types of crimpers, but the preferred crimper is a stuffer box crimper 17 in which the fibrillated film is fed by rolls at high speed into a closed box, causing it to buckle and collapse against the material already present in the box. Crimping, at least by a stuffer box, imparts both "primary" and "secondary" crimp. Primary crimp is the crimp on the fibers themselves, which is on the order of about 25–60 crimps per inch with a crimp amplitude of about 300–600 microns, while secondary crimp is a macroscopic accordion-like folding of the band as a whole. Primary crimp is desirable, while secondary crimp must be removed before filters are made from the tow.

The crimped tow is passed to layerer 18 in which a feed head moves back and forth layering the crimped tow in a container. The layered tow in the container is then compressed and banded in baler 19, and is ready to be used, once it is unpacked and its secondary crimp is removed, to make cigarette filters.

The heating performed in steam chest 16 improves the primary crimp obtainable from the fibrillated tow. First, heating of the fibrillated tow anneals the stresses and strains that are introduced in orientation oven 14 and fibrillator 15 and causes controlled fiber shrinkage. Second, the controlled annealing enables the presentation of a more homogeneous mass of fiber to crimper 17, reducing the range of force required to impart crimp. In fact, the heating step of the present invention is most effective when the tow is passed to the crimper while its temperature is still above ambient.

Figure 2:
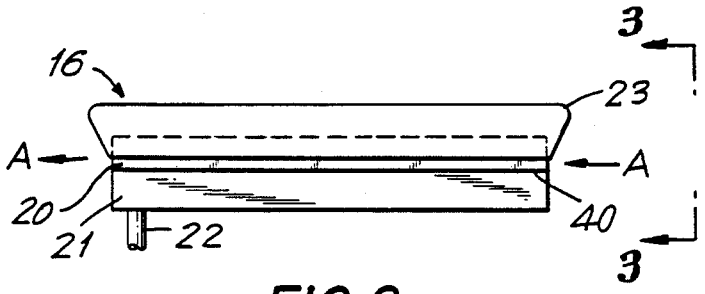
FIG. 2 is a side elevational view of a preferred embodiment of the heating means of FIG. 1.
Figure 3:
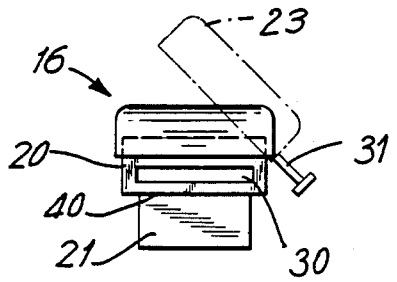
FIG. 3 is an end elevational view of the heating means of FIG. 2, taken from line 3—3 of FIG. 2.
Figure 4:
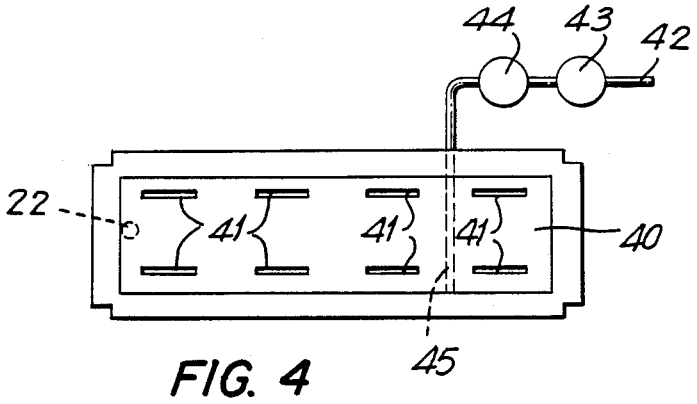
FIG. 4 is a horizontal cross-sectional view of the heating means of FIGS. 2 and 3, taken from line 4—4 of FIG. 2.

Steam chest 16 is shown in more detail in FIGS. 2–4. Tow passes through steam chest 16 in the direction indicated by arrows A, entering through entrance slot 30 and exiting through a corresponding exit slot (not shown) at the other end. Steam chest 16 is divided into upper and lower chambers 20, 21 by a horizontal baffle plate 40 having elongated slots 41. Steam enters via steam inflow line 42, controlled by pressure regulator 43 and flow meter 44. In flow line 42 terminates in lower chamber 21, where it is perforated at 45 allowing steam to enter chamber 21. The steam rises through slots 41 and contacts the tow in chamber 20. Condensed steam exits through drain 22. Steam that does not condense exits through the tow entrance and exit slots 30. Tight-fitting lid 23 can be opened, as shown in FIG. 3, by lever arm 31 which can be attached, e.g., to a hydraulic cylinder (not shown).

Steam is fed through steam chest 16 at a temperature of between about 95° C. and about 120° C., preferably about 100° C., at a flow rate of between about 2 kg/hr and about 10 kg/hr, preferably about 3 kg/hr. The speed of the tow as it passes through steam chest 16 is such that the dwell time in steam chest 16 is between about 0.1 second and about 6.0 about seconds, preferably about 0.25 second.

It is also possible to heat the fibrillated tow before crimping using apparatus other than steam chest 16. For example, the tow might be passed through a hot-air or infrared oven. The tow might also be wetted and passed through a microwave cavity. Finally, the tow might be passed over a heated plate, such as a stainless steel plate, heated by hot oil flowing through it or by some other suitable heating mechanism.

The effects on filter yield of heating polyolefin tow before crimping, as in the present invention, are apparent from the following examples.

EXAMPLE 1

A blend comprising 92% polypropylene homopolymer having a melt index of 1.8 (measured according to ISO standard 1133 at 230° C., 2.16 kgf), 7% low density polyethylene having a melt index of 1.0 (measured according to ISO standard 1133 at 190° C., 2.16 kgf), and 1% polypropylene masterbatch containing 25% by weight titanium dioxide (rutile grade, fine crystal structure, micronized grade) was extruded using a known blown film technique to produce a film of 35 microns in thickness. This film was slit into 6 portions of equal width, stacked and oriented in a longitudinal direction with a stretch ratio of 8:1 to produce films of 12.4 microns in thickness. The oriented films were passed around part of the periphery of a pinned fibrillating roller under the following conditions:

| | |
|---|---|
| Fibrillator roller diameter (mm) | 190 |
| Pins in space staggered relationships in pairs of parallel rows extending across the roller on lines inclined to lines parallel to the roller axis, immediately adjacent pairs of rows being oppositely inclined: | |
| Number of rows of pins | 180 |
| Pin density each row | 25 pins per inch (ppi) |
| Angle of rake of pins (angle of pins to tangent to roller in opposite direction to that of roller rotation) | 60° |
| Pin projection | 1 mm |
| Pin diameter | 0.4953 mm |
| Arc of contact of film with roller | 37° |
| Film input speed | 144 m/min |
| Surface speed of fibrillator rolls (Fibrillation ratio of 2.0:1) | 288 m/min |

The fibrillated films so produced has a total linear density of 32,000 denier and were submitted to a stuffer box crimping operation.

The textured fiber tow so produced was submitted to a decrimping operation in a known manner producing a bloomed flocculent mass, the crimp characteristics of which were 360 microns amplitude and 29.8 cpi frequency.

On making this material up into filter rods using conventional filter rod making equipment, filter rods with the following properties were produced:

| | Minimum Point | Maximum Point |
|---|---|---|
| Filter rod length: 66 mm | | |
| Filter rod circumference: 24.55 mm | | |
| Net weight of fibrillated fiber tow per rod (mg) | 246 | 288 |
| Pressure drop across filter rod at flow rate of 1050 ml/min (mmWG) | 174 | 239 |
| Yield (%) | 71 | 83 |
| Filter rod weight variability | | |
| Coefficient of variability (%): 1.9 | | |

EXAMPLE 2

Fibrillated films produced as described in Example 1, having a total linear density of 32,000 denier, were submitted to a thermal shock treatment by exposure to wet steam. This was accomplished by passing the fibers through a steam chest while holding them between nipped sets of rollers prior to submitting them to the stuffer box crimping operation. The steam chest length was 600 mm and the fiber dwell time in the chest was 0.25 seconds. The steam temperature was 100° C. and the steam flow rate was 3 kg/hr. The observed difference in speed between nip roll sets was 2.0%, the draw roll set turning more slowly because of shrinkage caused by the heat, as described above.

The textured fiber tow so produced was submitted to a decrimping operation in a known manner producing a bloomed flocculent mass, the crimp characteristics of which were 324 microns amplitude and 42.1 cpi frequency.

On making this material up into filter rods using conventional filter rod making equipment, filter rods with the following properties were produced:

| | Minimum Point | Maximum Point |
|---|---|---|
| Filter rod length: 66 mm | | |
| Filter rod circumference: 24.55 mm | | |
| Net weight of fibrillated fiber tow per rod (mg) | 276 | 323 |
| Pressure drop across filter rod at flow rate of 1050 ml/min (mmWG) | 194 | 283 |
| Yield (%) | 70 | 88 |
| Filter rod weight variability | | |
| Coefficient of variability (%): 1.14 | | |

As can be seen from the examples, the using a heating step range of yields obtainable before crimping is significantly higher as compared to the range of yields obtainable without the heating step, while the variability of produced filters is significantly lower.

Thus it is seen that a method and apparatus are provided to increase crimp frequency and uniformity in fibrillated polyolefin filter tow and thereby to improve the yield of the filter tow and to decrease filter variability. One skilled in the art will appreciate that the present invention can be practiced by other than the described embodiments, which are presented for purposes of illustration and not of limitation, and the present invention is limited only by the claims which follow.

What is claimed is:

1. A method of making polyolefin filter tow, said method comprising, in the listed order, the steps of:

forming a polyolefin film having a molecular structure;

orienting said molecular structure by heating said film to just below the melting point of said film and stretching said heated film;

fibrillating said oriented film to form an interconnected fiber web;

applying heat to said fibrillated web to raise its temperature above ambient temperature;

ending the application of heat to said fibrillated web;

crimping said heated fibrillated web to apply thereto a crimp having a crimp frequency of at least about 40 crimps per inch; and forming said crimped fibrillated web into filter tow, said filter tow having a maximum yield of at least about 85%.

2. The method of claim 1 wherein said heat applying step comprises heat applying fibrillated web to a temperature of between about 95° C. and about 120° C.

3. The method of claim 2 wherein said heating step comprises heating said fibrillated web to a temperature of about 100° C.

4. The method of claim 1 wherein said crimping step is performed before said heated fibrillated web cools to ambient temperature.

5. The method of claim 4 wherein said crimping step is performed while the temperature of said heated fibrillated web is above about 95° C.

6. The method of claim 5 wherein said crimping step is performed while the temperature of said heated fibrillated web is about 105° C.

7. The method of claim 1 wherein said heat applying step comprises passing said fibrillated web through a steam chest.

8. The method of claim 7 wherein said heat applying further comprises passing steam through said steam chest at a temperature of between about 95° C. and about 120° C. at a flow rate of between about 2 kg/hr and about 10 kg/hr, said fibrillated web having a dwell time in said steam chest of between about 0.1 second and about 6.0 seconds.

9. The method of claim 8 wherein said steam temperature is about 100° C.

10. The method of claim 8 wherein said steam flow rate is about 3 kg/hr.

11. The method of claim 8 wherein said dwell time is about 0.25 second.

12. The method of claim 1 wherein said heat applying step comprises passing said fibrillated web over a heated metallic plate.

13. The method of claim 12 wherein said heat applying step comprises passing said fibrillated web over an oil-heated metallic plate.

14. The method of claim 1 wherein said heat applying step comprises passing said fibrillated web through a hot-air oven.

15. The method of claim 1 wherein said heat applying step comprises passing said fibrillated web through an oven heated by infrared radiation.

16. The method of claim 1 wherein said heat applying step comprises wetting said fibrillated web and passing it through a microwave cavity.

17. The method of claim 1 wherein said crimping step comprises feeding said heated fibrillated tow to a stuffer box crimper.

18. The method of claim 1 wherein said crimp frequency is about 42.1 crimp per inch.

19. The method of claim 1 wherein said maximum yield is about 88%.

* * * * *